United States Patent [19]

Cunningham

[11] Patent Number: 4,662,034

[45] Date of Patent: May 5, 1987

[54] SNAP-ON BUTTON

[76] Inventor: John Cunningham, 2959 E. Seven Mile Rd., Detroit, Mich. 48234

[21] Appl. No.: 848,794

[22] Filed: Apr. 7, 1986

[51] Int. Cl.[4] ..... A44B 1/18

[52] U.S. Cl. ..... 24/90 R; 24/92; 24/94; 24/108

[58] Field of Search ..... 24/90 R, 92, 93, 94, 24/95, 103, 107, 108

[56] References Cited

U.S. PATENT DOCUMENTS

| | | | |
|---|---|---|---|
| 405,529 | 6/1889 | Bryant | 24/90 R |
| 1,277,595 | 9/1918 | Jaffe | 24/108 |
| 3,534,446 | 10/1970 | Silver | 24/92 |
| 3,623,192 | 11/1971 | Papazian | 24/90 R |
| 3,705,443 | 12/1972 | Camporese et al. | 24/90 R |
| 3,771,199 | 11/1973 | Eldringhoff | 24/92 |
| 3,892,013 | 7/1975 | Gould | 24/90 R |
| 4,040,148 | 8/1977 | Fukumoto | 24/108 |
| 4,194,272 | 3/1980 | Taffurelli | 24/90 R |

FOREIGN PATENT DOCUMENTS

| | | | |
|---|---|---|---|
| 647376 | 12/1950 | United Kingdom | 24/94 |

*Primary Examiner*—Victor N. Sakran
*Attorney, Agent, or Firm*—Krass & Young

[57] ABSTRACT

A button device including a standard button having the usual holes, a pair of pin members snapingly received in two of the holes in the button and projecting downwardly from the underside of the button, a housing adapted to be positioned against the underside of the associated fabric and including a pair of holes in its upper surface for receipt of the pins on the button, a sheet of spring steel positioned within the housing and including a pair of apertures adapted to receive the pins with an interference fit and including flap portions which flex downwardly in response to passage of the pins and engage in notches in the pins to secure the button to the housing, and a release pin passing through an aperture in the lower surface of the housing and engaging an aperture in the spring sheet to flex the flap portions of the spring sheet further downwardly to a disengaged position in which the pins of the button are free to be withdrawn from the housing to allow the button device to be separated from the associated fabric.

9 Claims, 6 Drawing Figures

SNAP-ON BUTTON

BACKGROUND OF THE INVENTION

This invention relates to button devices and more particularly to button devices which may be readily attached to and removed from an associated fabric.

Typically, buttons are fastened to an associated fabric by the use of a suitable thread which is applied through appropriate openings in the button and passed through the fabric by the use of a suitable needle. Whereas this typical fastening technique is generally satisfactory, it does require a considerable amount of dexterity and skill and the buttons fastened by this technique invariably eventually separate from the associated fabric and must be reattached. Reattachment involves the availability of the appropriate thread and the appropriate needle and, as with the initial attachment, requires a considerable amount of dexterity and skill.

In an effort to overcome this difficulty in attaching buttons, or in reattaching buttons that work loose, various devices have been proposed in which the button is attached to a fabric by a piercing shaft and a suitable attachment member which is positioned on the opposite face of the fabric and receives the piercing shaft to lock the button to the fabric. Whereas these piercing shaft type arrangements have obviated the need for needle and thread and the need for the requisite skill to use the needle and thread, they usually operate to permanently attach the button to the fabric or, at best, are very difficult to separate from the fabric so that, in general, the buttons are essentially dedicated to the particular fabric to which they are initially affixed.

SUMMARY OF THE INVENTION

This invention relates to a button device which may be readily attached to the associated fabric without the use of needle and thread and which may be readily released from the associated fabric for purposes of repair, replacement, or usage on a different fabric.

The button device of the invention includes a button member having a generally disk-shaped main body portion, adapted to be positioned against the upper surface of a first fabric section and configured to be put through a buttonhole in a second fabric section, and a pin portion extending downwardly from the underside of the main body portion for downward passage through the first fabric section. The device further includes an attachment assembly adapted to be positioned against the undersurface of the first fabric section and including means for releasably securing the pin portion of the button member thereto in response to movement of the pin portion downwardly through the first fabric section and into the attachment assembly and means for releasing the pin portion from the attachment assembly to allow the withdrawal of the pin portion upwardly through the first fabric section and release of the button device from the first fabric section. This arrangement allows the button device to be readily secured to the associated fabric and readily removed from the fabric when the occasion or need arises.

According to a further feature of the invention, the pin portion of the button device includes at least one notch; the securing means includes a spring member lockingly engagable with the notch and the pin portion to preclude upward withdrawal of the pin portion; and the releasing means includes means for moving the spring member out of locking engagement with the notch in the pin portion. This arrangement provides a simple and effective assembly for readily attaching the button device to the associated fabric and readily detaching the button device from the fabric.

According to a further feature of the invention, the spring member comprises portions of sheet spring material defining an aperture sized to pass the pin portion of the button member with an interference fit and means allowing the edges of the sheet spring portions at opposite sides of the aperture to flex downwardly in response to passage of the pin portion and into engagement with the notch in the pin portion. This arrangement provides a simple and effective mechanism for lockingly engaging the pin portion.

According to a further feature of the invention, the sheet spring portions comprises a pair of flap portions defining confronting edges; the aperture is defined at the confronting edges of the flap portions; and the flap portions flex downwardly and outwardly to their position of engagement with the notch in response to passage of the pin portion downwardly through the aperture.

According to a further feature of the invention, the releasing means comprises means operative to pivot the flap portions further downwardly from their engaged positions to disengaged positions to release the pin portion from the flap portions. This arrangement provides a simple and effective mechanism for allowing the button device to be released from the associated fabric for repair, replacement or the like.

According to a further feature of the invention, a second aperture is defined at the confronting edges of the flap portions and the releasing means comprises a pin having an enlarged end portion with a cam surface coacting with the second aperture to move the flap portions to their disengaged positions.

According to a further feature of the invention, the button member includes a second pin portion having a notch; a third aperture is confined at the confronting edges of the flap portions for coaction with the second pin portion; and the second aperture is positioned between the first and third apertures. This arrangement provides a convenient and compact assembly including spaced pin portions on the button member and a central release pin acting centrally of the pin portions.

According to a further feature of the invention, the pin portions are snappingly received in the standard holes in a regulation button and extend downwardly from the underside of the button for coaction with the attachment assembly. This arrangement allows the standardized button to be used with the present invention without alteration.

In the disclosed embodiment of the invention, the attachment assembly includes a housing adapted to be positioned with its upper surface against the undersurface of the associated fabric; the sheet spring portions are positioned within the housing; and the housing includes a plurality of apertures at its upper surface for respective receipt of the pin portions of the button member and a single aperture in its undersurface for receipt of the release pin. This arrangement provides a compact package which effectively provides both the attachment and release functions.

DETAILED DESCRIPTION OF THE PREFERRED EMBODIMENT

Figure 1:
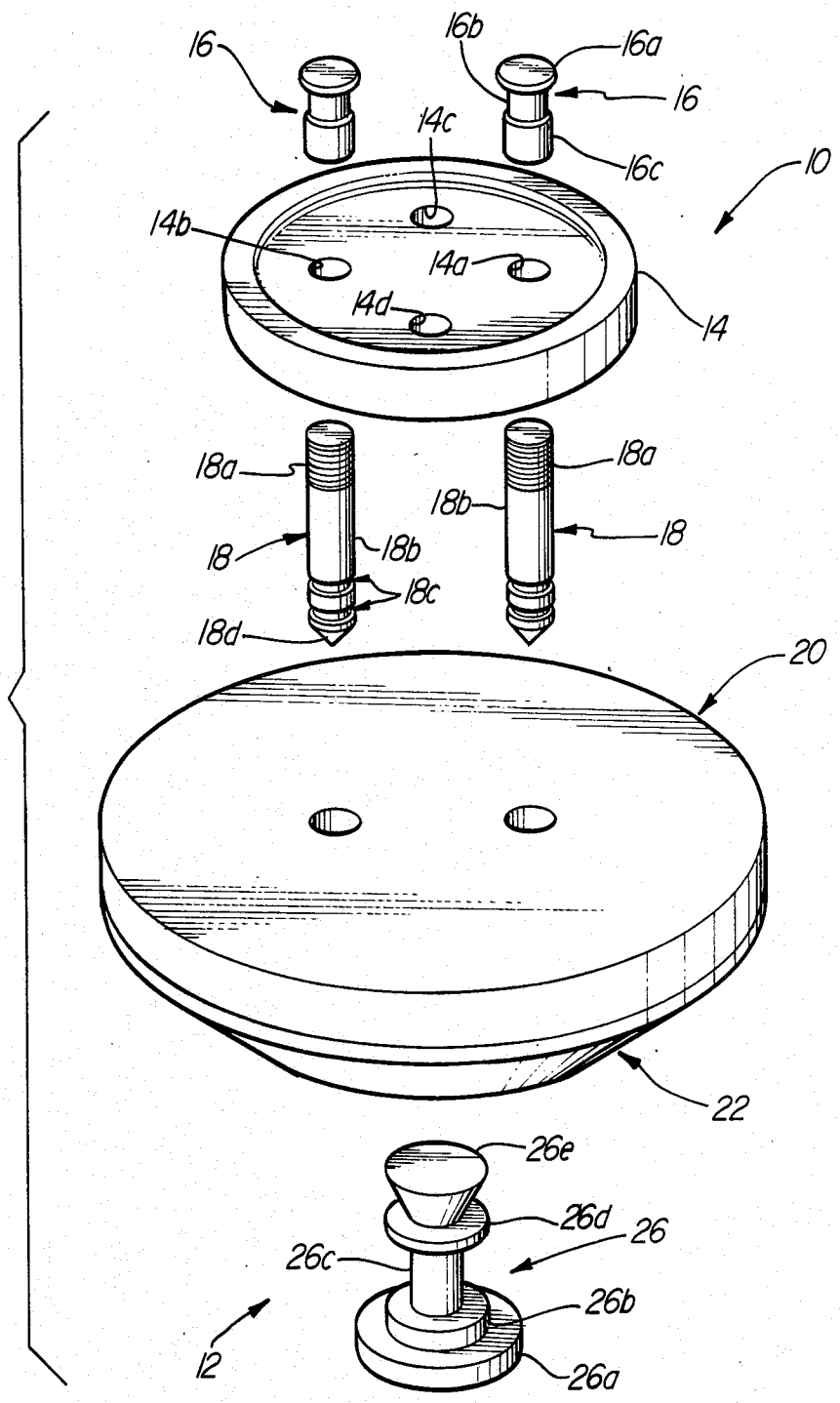
FIG. 1 is an exploded perspective view of a button device according to the invention.

The invention button device, broadly considered, includes a button assembly 10 and an attachment assembly 12.

The button assembly 10 includes a standard button 14 having the usual four holes 14*a*, 14*b*, 14*c* and 14*d*; a pair of plugs 16; and a pair of pins 18.

The plugs 16 include head portions 16*a*, solid upper portions 16*b*, and hollow lower portions 16*c*. Upper portion 16*b* is sized to snap into one of the holes in the button with head portion 16*a* seating against the upper face of the button and hollow lower portion 16*c* positioned beneath the underface of the button. Hollow lower portion 16*c* defines a downwardly opening cavity 16*d*. Plugs 16 are preferably formed of a suitable plastic material.

Pins 18 are preferably formed of a suitable metal material, such as stainless steel, and each include a plurality of ridges 18*a* formed in the upper end of the pin; a central shank portion 18*b*; a plurality of circumferential notches 18*c* formed in the lower portion of the pin; and a pointed end portion 18*d*. Pins 18 are inserted upwardly into sockets 16*d* of plugs 16 with ridges 18*a* interferingly coacting with the adjacent surface of sockets 16*d* to firmly secure the upper ends of the pins in the hollow lower portions 16*c* of the plugs.

Alternatively, each pin 18 and plug 16 may be formed as an integral, one piece molded assembly and the molded assemblies may be suitably passed through and snap fitted into the holes in the button.

As a further alternative, button 14 may comprise a special designer button and the pins 18 may be integrally molded with the button to provide a designer button assembly.

Attachment assembly 12 includes an upper housing member 20; a lower housing member 22; a spring steel sheet 24; and a release pin 26. Housing members 20 and 22 are formed of a suitable plastic material; sheet 24 is formed of a suitable spring material; and release pin 2 is formed of a suitable metal material.

Upper housing 20 is generally disc shaped and includes a pair of apertures 20*a* extending through the member 20 and opening in the upper face 20*b* of the member 20. Apertures 20*a* have a diameter slightly greater than the diameter of pins 18 so as to freely pass the pins. Upper housing 20 further includes a central circular blind opening 20*c* opening in the lower face 20*d* of the housing member.

Lower housing 22 is generally disc shaped and includes a rectangular opening 22*a*, a countersunk rectangular opening 22*b*, a further countersunk circular opening 22*c*; and a circular opening 22*d* opening in the lower face 22*e* of member 22.

Release pin 26 includes a head portion 26*a*, shoulder portion 26*b*, a shank portion 26*c*, a collar portion 26*d*, and a cam or wedge portion 26*e*.

Sheet 24 is generally rectangular with chamfered edges 24*a* and is sized to fit within rectangular opening 22*a* in the upper face of lower housing member 22. Transverse slits 24*b* and a longitudinal slit 24*c* are provided in sheet 24 to define flap portions 24*d* and 24*e* which may flex downwardly about hinge lines 24*f*. A plurality of apertures 24*g*, 24*h* and 24*i* are defined along the confronting edges of flap portions 24*d* and 24*e* with longitudinal slot 24*c* in each case bisecting the aperture. Apertures 24*g* and 24*i* have a diameter slightly less than the diameter of pins 18 and aperture 24*h* has a diameter slightly greater than the narrow lower diameter of wedge portion 26*e* of release pin 26.

In the assembled relation of the attachment assembly 12, the lower face 20*d* of upper housing 20 is secured to the upper face 22*e* of lower housing 22 as by the use of heat sealing or a suitable adhesive; spring sheet 24 is positioned in rectangular opening 22*a* of housing 22 in sandwiched relation between the upper and lower housing members to dispose apertures 24*g* and 24*i* in underlying coaxial alignment with apertures 20*a* in the upper housing 20 and dispose central aperture 24*h* in coaxial alignment with opening 20*c* in upper housing 20 and opening 22*d* in lower housing 22; and release pin 26 is centrally disposed within the housing with wedge portion 26*e* received within opening 20*c*, a coil spring 28 urging collar 26*d* upwardly into engagement with the undersurface of the adjacent portions of sheet 24, and shoulder 26*n* urged upwardly into engagement with the undersurface 22*e* of housing 22.

In the operation of the invention button device, plugs 16 are snapped into holes 14*a* in button 14, pins 18 are inserted into plug cavities 16*d*, attachment assembly 20 is positioned adjacent the undersurface of the associated fabric, and pins 18 are passed downwardly through the upper surface of the associated fabric for entry into holes 20*a*. As the pins pass downwardly through housing 20 they pass with an interference fit through apertures 24*g* and 24*i* and flex flap portions 24*d* and 24*e* downwardly about hinge lines 24*f*. As the confronting edges of the downwardly flexed flap portions encounter a notch 18*c* in the pin, they enter the notch and lock the pins with respect to the attachment assembly. The button device is now firmly secured to the associated fabric with the particular notch 18*c* engaged by flap portions 24*d* and 24*e* determined by the thickness of the fabric. Whereas only two notches are shown on each pin, it will be obvious that more than two notches may be provided if it is desired to accommodate more than two fabric thicknesses.

Figure 2:
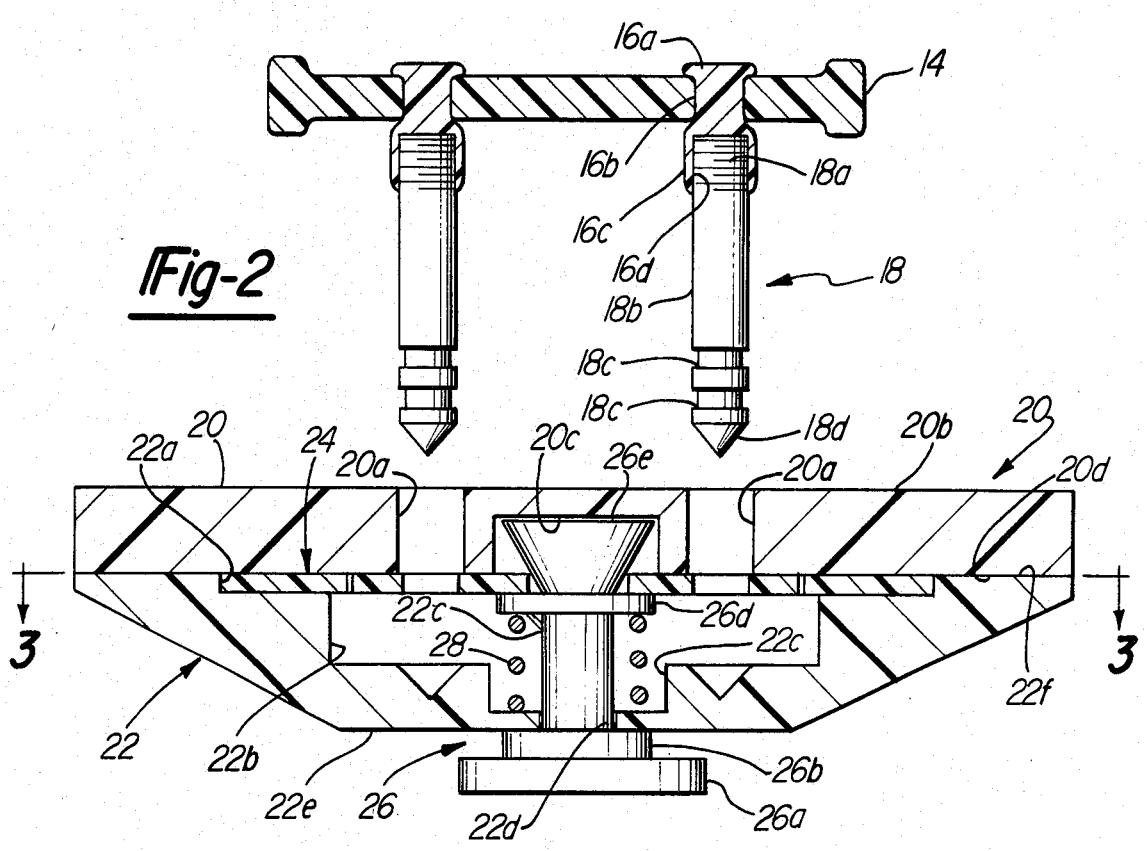
FIG. 2 is a partially assembled view of the button device of FIG. 1.
Figure 3:
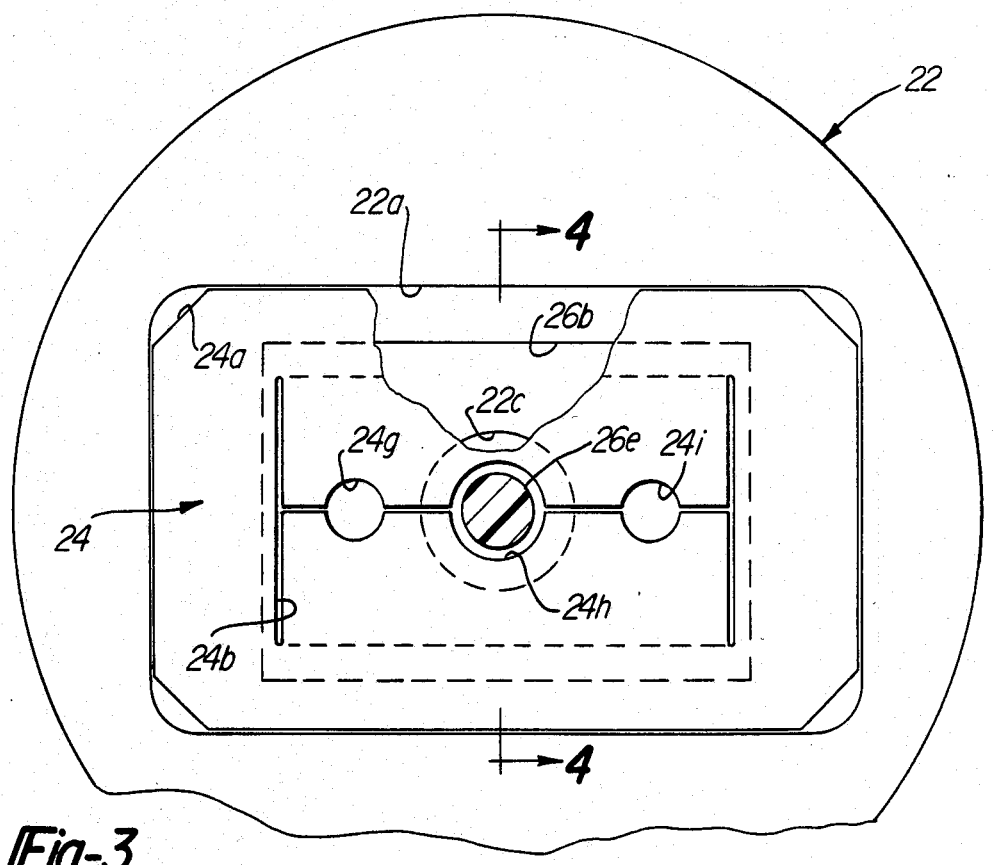
FIG. 3 is a cross sectional view taken on line 3—3 of FIG. 2.
Figure 4:
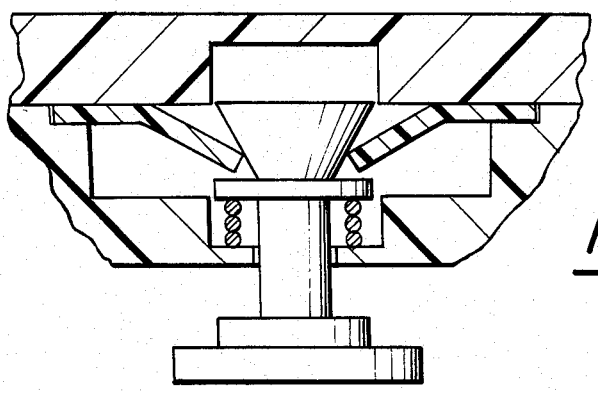
FIG. 4 is a fragmentary cross sectional view taken on line 4—4 of FIG. 3.
Figure 6:
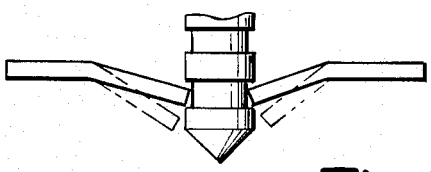
FIG. 6 is a diagrammatic view showing the attaching and releasing functions of the invention button device.
Figure 5:
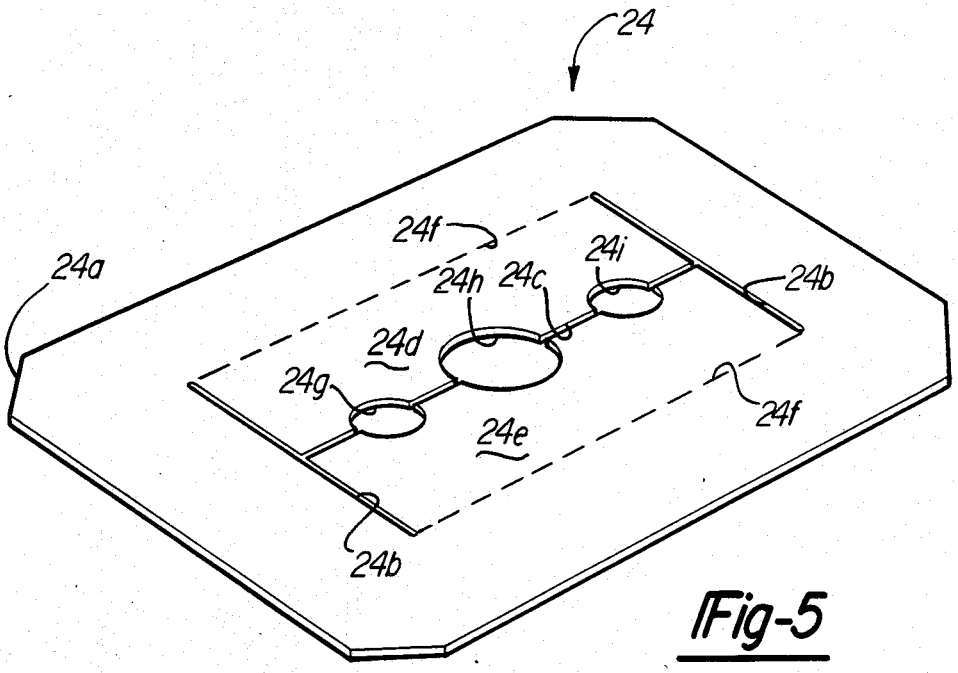
FIG. 5 is a perspective view of a spring sheet member used in the invention button device.

The firm engagement of the confronting edges of flap portions 24*d* and 24*e* in the respective notches in the pins positively precludes inadvertant removal of the button assembly from the attachment assembly and maintains the button device in position on the associated fabric even through sustained periods of heavy usage. If, however, it is desired to remove the button device from the fabric, either for repair, replacement, cleaning of the fabric or the like, head portion 26*a* of release pin 26 is grasped and pulled downwardly, as viewed in FIG. 2, to cammingly engage wedge portion 26*e* with aperture 24*h* and flex flap portions 24*d* and 24*e* further downwardly from their notch engaging positions to a disengaged position, as seen in solid lines in FIG. 4 and dotted lines in FIG. 6, wherein the confronting edges of the flap portions have been moved out of engagement with the notches in the pins 18 so that the button assembly 14 may be pulled upwardly to remove pins 18 from the attachment assembly and separate the button assembly from the attachment assembly and thereby release the button device from the associated fabric. The invention button device may be reattached as desired to the same associated fabric, or the button device may be attached to a different associated fabric in order to impart the particular ornamental appearance of the button device to that fabric.

It will be seen that the invention button device allows a button to be readily attached to and detached from associated fabrics so that any particular button may be used in any particular position on any particular fabric without the use of needle and thread and may be removed from the associated fabric by simply pulling on release pin 26. The invention button device provides a button that is more resistant to detachment from the associated fabric than buttons attached by the usual needle and thread and yet which may be readily detached from the associated fabric when the occassion demands.

Although a preferred embodiment of the invention has been illustrated and described in detail, it will be apparent that various changes may be made in the disclosed embodiment with departing from the scope or spirit of the invention.

I claim:

1. A button device adapted to be releasably secured to a first fabric section for coaction with a buttonhole in a second fabric section to releasably secure the fabric sections together, said device comprising:

(A) a button member having (1) a generally disc shaped main body portion adapted to be positioned against the upper surface of the first fabric section and configured to be put through the buttonhole in the second fabric section, and (2) a pin portion extending downwardly from the underside of said main body portion for downward passage through the first fabric section; and (B) an attachment assembly including (1) a housing having a generally planar upper surface adapted to be positioned against the under surface of the first fabric section, a blind bore extending downwardly in said housing and opening in an attachment aperture sized to pass said pin portion for downward movement into said blind bore, a lower surface spaced downwardly from said upper surface, and a blind bore extending upwardly in said housing and opening in said lower surface in a release aperture, (2) catch means, positioned within said housing in intersecting relation to said blind bores, operative in response to movement of said pin portion downwardly through the first fabric section and into said downwardly extending blind bore to releasably secure said pin portion to said housing, and (3) an elongated release member extending upwardly into said upwardly extending blind bore for engagement at its upper end with said catch means and operative in response to actuation thereof to release said pin portion from said catch means to allow the withdrawal of said pin portion upwardly through the first fabric section and release of the button device from the first fabric section.

2. A button device according to claim 1 wherein:

(C) said pin portion includes at least one notch therein;

(D) said catch means includes a spring member lockingly engageable with said notch in said pin portion to preclude upward withdrawal of said pin portion; and (E) said release member includes means for moving said spring member out of locking engagement with said notch.

3. A button device according to claim 2 wherein:

(F) said spring member comprises portions of sheet spring material;

(G) said sheet spring portions define a catch aperture sized to pass said pin portion of said button member with an interference fit and means allowing the edges of said sheet spring portions at opposite sides of said catch aperture to flex downwardly in response to passage of said pin portion and into engagement with said notch.

4. A button device according to claim 3 wherein:

(H) said sheet spring portions comprise a pair of flap portions defining confronting edges;

(I) said catch aperture is defined at the confronting edges of said flap portions; and (J) said flap portions flex downwardly and oppositely to their position of engagement with said notch in reponse to passage of said pin portion downwardly through said catch aperture.

5. A button device according to claim 4 wherein:

(K) said release member comprises means operative to pivot said flap portions further downwardly from their engaged positions to disengaged positions to release said pin portion from said flap portions.

6. A button device according to claim 5 wherein:

(L) a second release aperture is defined at the confronting edges of said flap portions; and (M) said elongated release member passes at its upper end through said release aperture and includes an enlarged upper end portion with a cam surface coacting with said flap portions to move said flap portions to their disengaged positions.

7. A button device according to claim 6 wherein:

(N) said button member includes a second pin portion having a notch;

(O) a third aperture is defined at the confronting edges of said flap portions for coaction with said second pin portion and with said notch in said second pin portion; and (P) said second aperture is positioned between said first and third apertures.

8. A button device adapted to be releasably secured to a first fabric section for coaction with a buttonhole in a second fabric section to releasably secure the fabric sections together, said device comprising:

(A) a button member having (1) a main body portion adapted to be positioned with its underside adjacent one surface of the first fabric section and configured to be put through the button hole in the second fabric section, and (2) a plurality of pin portions extending from the underside of said main body portion for passage through the first fabric section; and (B) an attachment assembly including (1) a housing adapted to be positioned with its upper surface against the other surface of the first fabric section and including a plurality of apertures in its upper surface for respective receipt of said pin portions, (2) catch means within said housing operative in response to movement of said pin portions through said apertures to releasably secure said pin portions to said housing, and (3) an elongated release member passing through an aperture in the under surface of said housing for engagement with said catch means and operative when actuated to release said pin portions from said catch means.

9. A button device according to claim 8 wherein:

(C) said catch means comprises sheet spring portions received within said housing and defining a plurality of aligned apertures for respective receipt of said pin portions and said release pin with a split line passing through the centers of said apertures and the sheet portions otherwise cut to allow flexing movement of said portions on opposite sides of said split line in response to movement of said pin portions through their respective apertures and in response to movement of said release pin through its respective aperture.

* * * * *